US006206322B1

(12) United States Patent
Elliott et al.

(10) Patent No.: US 6,206,322 B1
(45) Date of Patent: Mar. 27, 2001

(54) TOWEL DISPENSER WITH ANTI-FREE WHEEL MECHANISM

(75) Inventors: Adam Troy Elliott; William Thomas Kearney, III, both of Lexington, KY (US)

(73) Assignee: Bay West Paper Corporation, Harroldsburg, KY (US)

( * ) Notice: Subject to any disclaimer, the term of this patent is extended or adjusted under 35 U.S.C. 154(b) by 0 days.

(21) Appl. No.: 09/337,152

(22) Filed: Jun. 21, 1999

(51) Int. Cl.[7] ..... B65H 20/04

(52) U.S. Cl. ..... 242/564.2; 242/564.3; 192/17 R; 74/133

(58) Field of Search ..... 242/564.2, 564.4, 242/564.1, 564.3, 565; 226/144, 145; 74/133; 192/17 R, 12 B

(56) References Cited

U.S. PATENT DOCUMENTS

| | | | | |
|---|---|---|---|---|
| 1,084,598 | | 1/1914 | Antone . | |
| 1,975,414 | | 10/1934 | Wade . | |
| 2,004,431 | * | 6/1935 | Fitz Gerald | 74/133 |
| 2,164,673 | * | 7/1939 | Yarian | 74/133 |
| 2,584,212 | * | 2/1952 | Lanegan et al. | 71/133 |
| 2,622,873 | | 12/1952 | Wenneche . | |
| 2,830,810 | * | 4/1958 | Colburn et al. | 226/145 |
| 3,010,338 | * | 11/1961 | Layton | 242/564.2 |
| 3,045,885 | * | 7/1962 | Dahlin et al. | 226/144 |
| 3,059,982 | | 10/1962 | Dahlin . | |
| 3,107,957 | | 10/1963 | Batlas et al. . | |
| 3,127,121 | | 3/1964 | Babin . | |
| 3,266,338 | | 8/1966 | Layton et al. . | |
| 3,606,125 | | 9/1971 | Tucker et al. . | |
| 4,192,442 | * | 3/1980 | Bastian et al. | 242/564.2 |
| 4,664,304 | * | 5/1987 | Wendt et al. | 242/564.2 |
| 5,061,232 | | 10/1991 | Bloch et al. . | |
| 5,294,192 | | 3/1994 | Omdoll et al. . | |
| 5,400,982 | | 3/1995 | Collins . | |
| 5,526,973 | * | 6/1996 | Boone et al. | 242/564.4 |
| 5,865,395 | | 2/1999 | Wei . | |

* cited by examiner

*Primary Examiner*—Katherine A. Matecki
(74) *Attorney, Agent, or Firm*—Merchant & Gould P.C.

(57) ABSTRACT

A towel dispenser for dispensing roll towel material, such as paper towel, cloth towel and the like. The dispenser includes an anti-free wheel mechanism incorporated therein to prevent the towel material from being pulled out of the dispenser without activating a dispensing mechanism. By preventing towel material from pulled out of the dispenser, excessive towel useage is prevented, thereby preventing towel material wastage. The anti-free wheel mechanism includes a latch that is secured to a pivoting lever of a dispensing mechanism, with the latch engaging with a dispensing gear of the dispensing mechanism to prevent rotation thereof when the lever is at its upper position. The latch is designed to disengage from the dispensing gear as the lever starts to move downward during a dispensing stroke.

10 Claims, 5 Drawing Sheets

TOWEL DISPENSER WITH ANTI-FREE WHEEL MECHANISM

FIELD OF THE INVENTION

This invention relates to towel dispensers that dispense towel, such as paper towel and the like. In particular, the invention relates to a towel dispenser having an anti-free wheel mechanism associated therewith to prevent towel from being manually pulled out of the dispenser. The invention is particularly useful for paper towel dispensers in order to prevent excessive use of paper towel and thereby avoid paper waste.

BACKGROUND OF THE INVENTION

Roll paper towel dispensers are well known. They are most commonly found in and around lavatories, bathrooms, wash sinks and the like to enable users to dry their hands and other body parts after washing. Paper towel dispensers are typically mounted onto a wall to permit user access thereto, with the dispensers being manually actuated by the user to dispense a desired length of paper towel from a paper towel roll. One drawback of many conventional paper towel dispensers is that the towel can be manually pulled from the dispenser by a user without actuating the dispensing mechanism typically provided therefor, thereby leading to excessive use of paper towel and thus paper waste.

One prior art paper towel dispenser that incorporates a device to prevent a user from pulling towel from the dispenser is U.S. Pat. No. 3,606,125 to Tucker et al. This device utilizes what is referred to as an anti-milking hook 130 that engages with a dispensing roll 30 and prevents rotation thereof when a user attempts to pull paper towel from the dispenser. This device also utilizes a pivotally mounted lever connected to a drive mechanism that causes paper towel dispense during both a downstroke and a return stroke of the lever.

U.S. Pat. No. 1,084,598 to Antone describes a paper towel dispenser having an idler gear 33 with a finger 34 that permits discharge of paper towel only when a wheel 29 is rotated.

In addition, U.S. Pat. No. 2,622,873 to Wenneche discloses a paper towel dispenser that utilizes a yoke 46 that permits a predetermined amount of paper towel to be pulled from the dispenser and thereafter locks the dispenser to prevent further dispense until the yoke is again actuated.

Additional dispensers that are designed to control paper towel dispense and/or prevent pulling of paper towel from the dispensers are illustrated in U.S. Pat. Nos. 5,865,395; 3,266,338; 4,192,442; and 3,107,957.

While these towel dispenser designs are adequate for their intended purposes, a continuing need exists for an improved towel dispenser that prevents excessive use of towel, such as paper towel, and thereby avoid paper waste.

SUMMARY OF THE INVENTION

The invention provides an improved towel dispenser for dispensing roll towel material, such as paper towel, cloth towel and the like, that is designed to prevent excessive use of the towel and thereby avoid towel waste. In particular, the towel dispenser of the invention includes an anti-free wheel mechanism incorporated therein to prevent the towel material from being pulled out of the dispenser without activating a dispensing mechanism. By preventing towel material from pulled out of the dispenser, excessive towel useage is prevented, thereby preventing towel material wastage.

In one embodiment in accordance with the invention, a towel dispenser is provided. The dispenser includes a housing, and a dispensing mechanism associated with the housing for dispensing towel stored within the housing. The dispensing mechanism includes a dispensing lever that is moveably supported by the housing whereby the lever is moveable from a first position to a second position and from the second position back to the first position, and a dispensing gear that is rotatably supported by the housing. The dispensing gear is in driving engagement with the dispensing lever and is rotatable thereby in a first direction. A latch is connected to the dispensing lever and is moveable therewith when the dispensing lever moves between the first and second positions. The latch is engaged with the dispensing gear to prevent rotation thereof in the first direction when the dispensing lever is at the first position.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

BRIEF DESCRIPTION DESCRIPTION OF THE DRAWINGS

DETAILED DESCRIPTION OF THE PREFERRED EMBODIMENT

Figure 1:
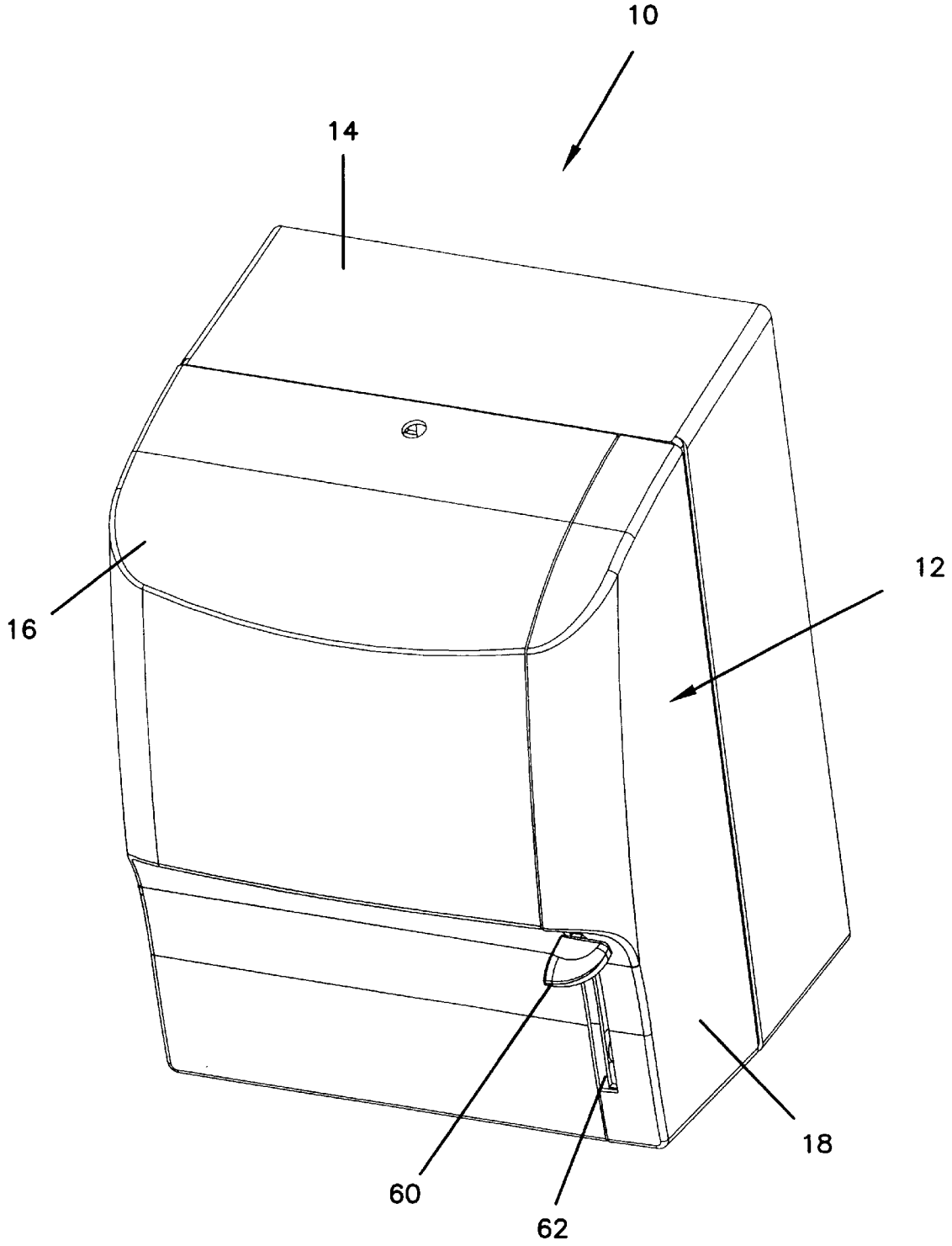
FIG. 1 is an upper, right-side perspective view of the towel dispenser in accordance with the invention.

One implementation of a towel dispenser constructed in accordance with the principles of the invention is illustrated in FIGS. 1–5, with the towel dispenser being referenced by the numeral 10. As shown in FIG. 1, the dispenser 10 includes a housing 12 that is formed from materials that are conventionally used to construct dispenser housings, such as plastic, metal and the like. The housing 12, which is of generally conventional construction, is formed of a rear housing portion 14 having top and bottom panels, side panels and a rear panel, a front housing portion 16 pivotally connected to the rear housing portion 14 to permit access to the interior of the housing 12, and a side housing portion 18 which is designed to house components associated with the operation of the dispenser 10. The front housing portion 16 is separated from the side housing portion 18, with the front housing portion 16 pivoting between open and closed positions to control access to the interior of the housing 12, and with the side housing portion 18 remaining fixed whereby it does not pivot with the front housing portion 16.

The rear housing portion 14, front housing portion 16 and side housing portion 18 define an interior cavity which contains one or more towel roll support mechanisms for supporting one or more towel rolls within the housing 12 for subsequent dispensing of towel material from the dispenser 10. Preferably, the towel roll(s) is a paper towel roll, although other kinds of towel rolls, such as cloth or fabric towel rolls, could be used as well. For purposes of this description, the dispenser 10 will be described as dispensing paper towel.

The rear panel of the rear housing portion is provided with mounting apparatus to allow the dispenser 10 to be mounted on a wall in and around lavatories, bathrooms, wash sinks and the like. The overall construction of the housing 12 is not pertinent to the invention, and the specific details thereof, as well as the details of paper towel roll support mechanism(s) and mounting apparatus, need not be further described.

Figure 2B:
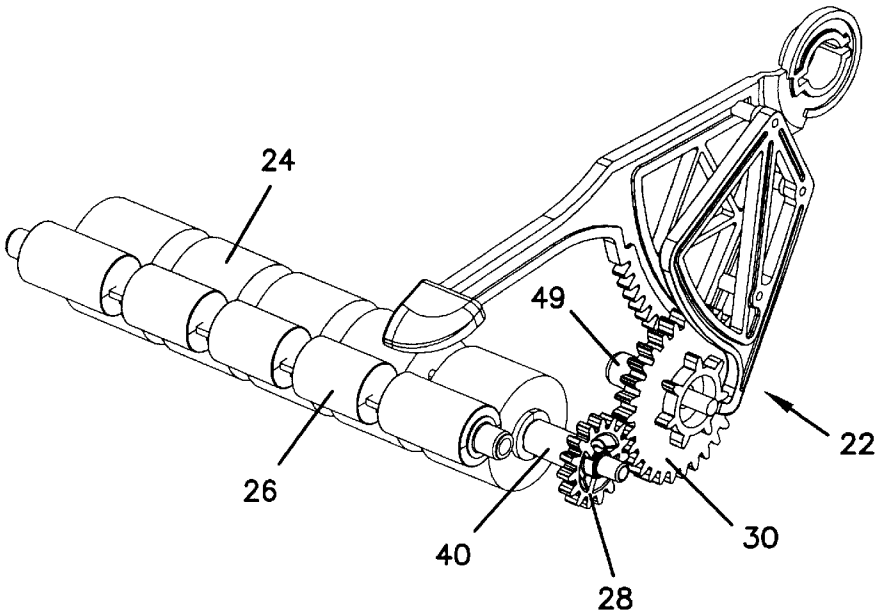
FIGS. 2A and 2B are perspective views of the dispensing mechanism and the anti-free wheel mechanism used in the towel dispenser, with the dispenser housing removed for clarity.
Figure 2A:
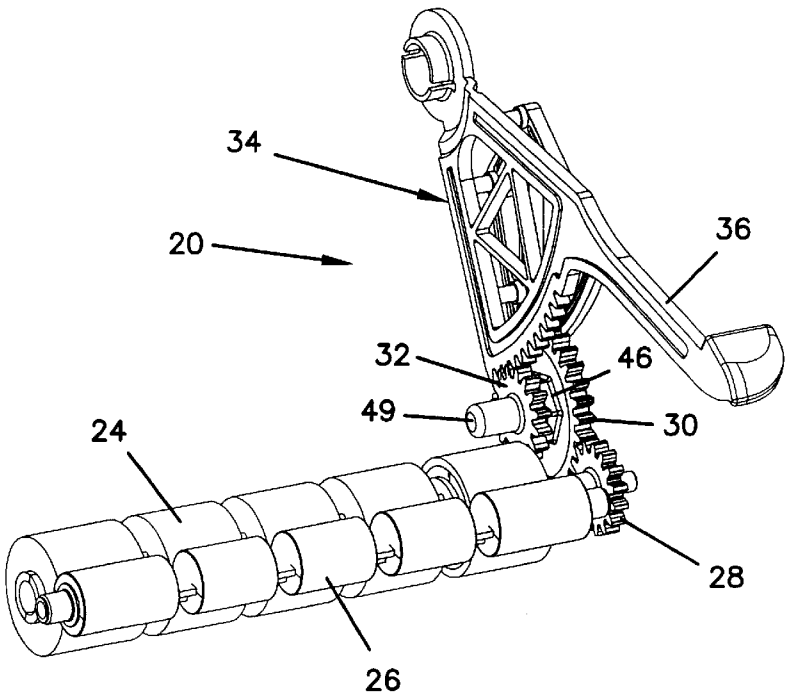

Turning now to FIGS. 2A and 2B, a dispensing mechanism 20 and an anti-free wheel mechanism 22 of the dispenser 10 are shown. The dispensing mechanism 20 and anti-free wheel mechanism 22 are, for the most part, disposed within the housing 12, except for one element that will be later described. However, to clarify the description and arrangement of the mechanisms 20, 22, the housing 12 is not shown in FIGS. 2A and 2B. The relationship of each mechanism 20, 22 relative to the housing 12 will become apparent from the description of FIGS. 3–5.

Specifically, the dispensing mechanism 20 includes a drive roll 24 and an idler roll 26 that are supported within the interior space of the housing 12 in a manner that is known in the art. The drive roll 24 and idler roll 26 form a nip therebetween through which a web (not shown) from the paper roll mounted within the housing 12 enters to be frictionally engaged by the drive roll 24. When the drive roll 24 is rotatably driven in a predetermined direction, the web is pulled from the paper roll through the nip with the leading edge thereof being discharged through a slot provided in the bottom of the housing 12. The details of the mounting and operation of the drive roll 24 and idler roll 26 are conventional in the art, and thus no further description thereof is believed to be necessary. For further details of the construction and operation thereof, reference can be made to the aforementioned U.S. Patents.

Figure 3:
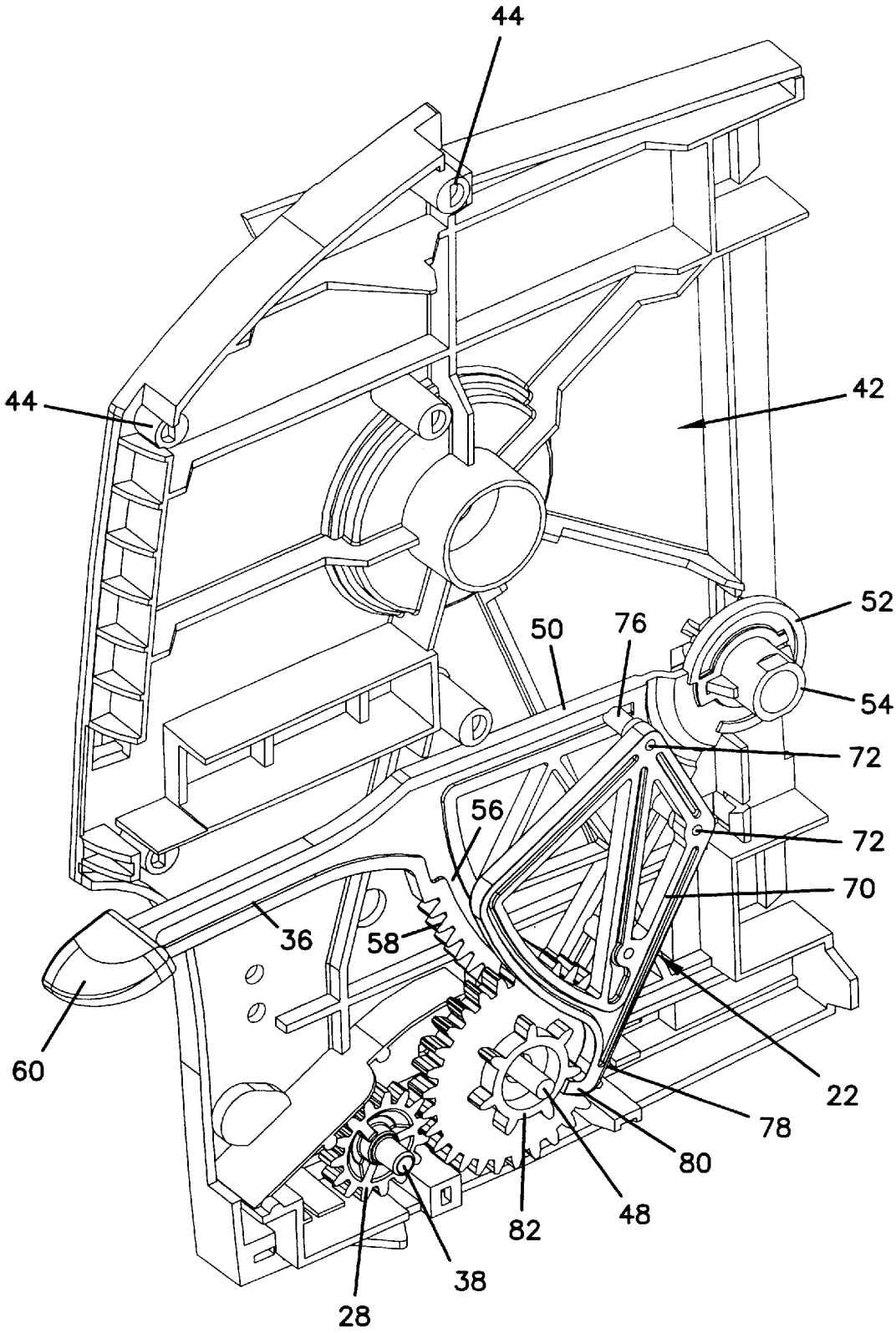
FIG. 3 is a right-side perspective view of the dispensing mechanism and the anti-free wheel mechanism in relation to an interior panel of the dispenser housing, with the anti-free wheel mechanism engaged.
Figure 4:
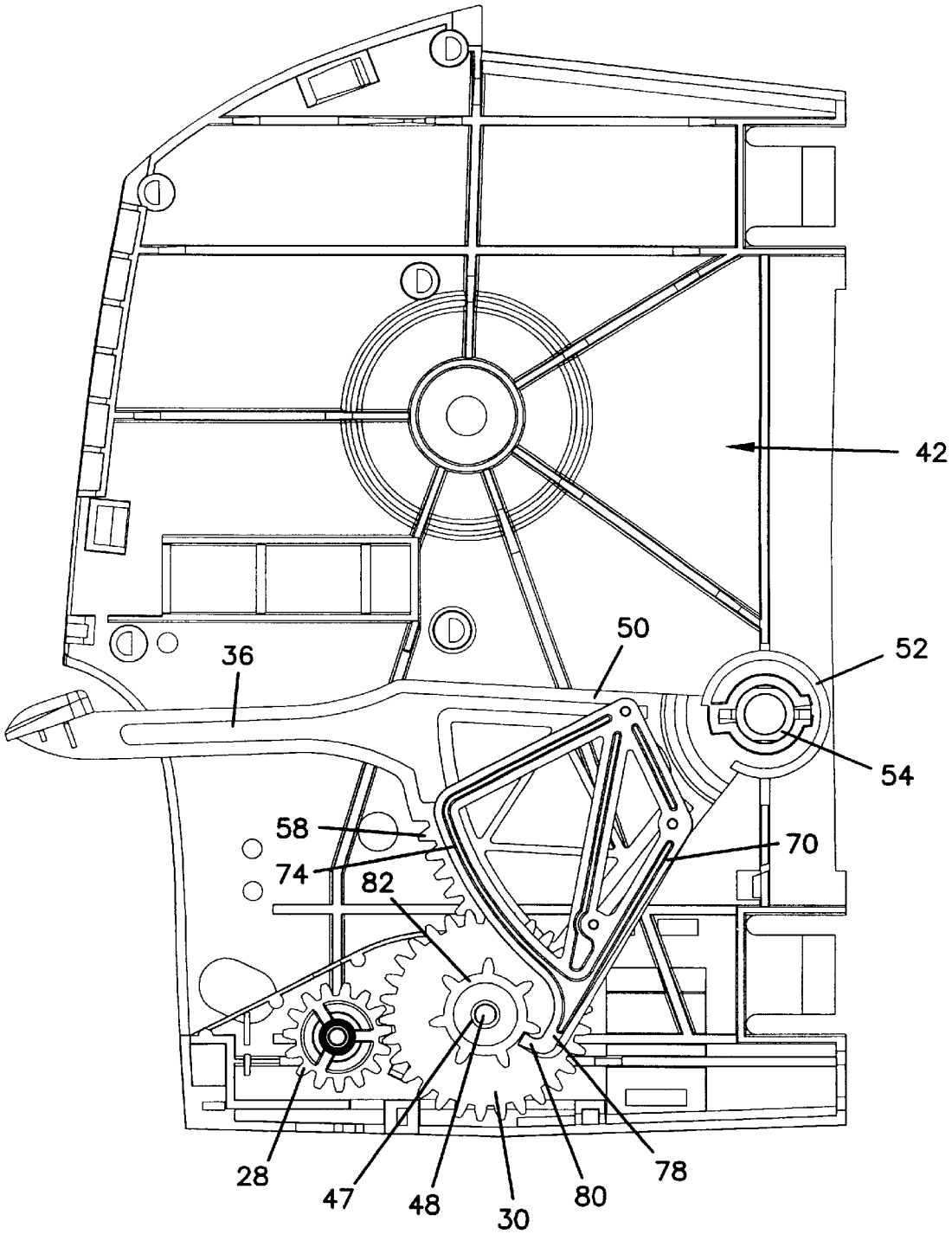
FIG. 4 is a side view of the dispensing mechanism and the anti-free wheel mechanism shown in FIG. 3.
Figure 5:
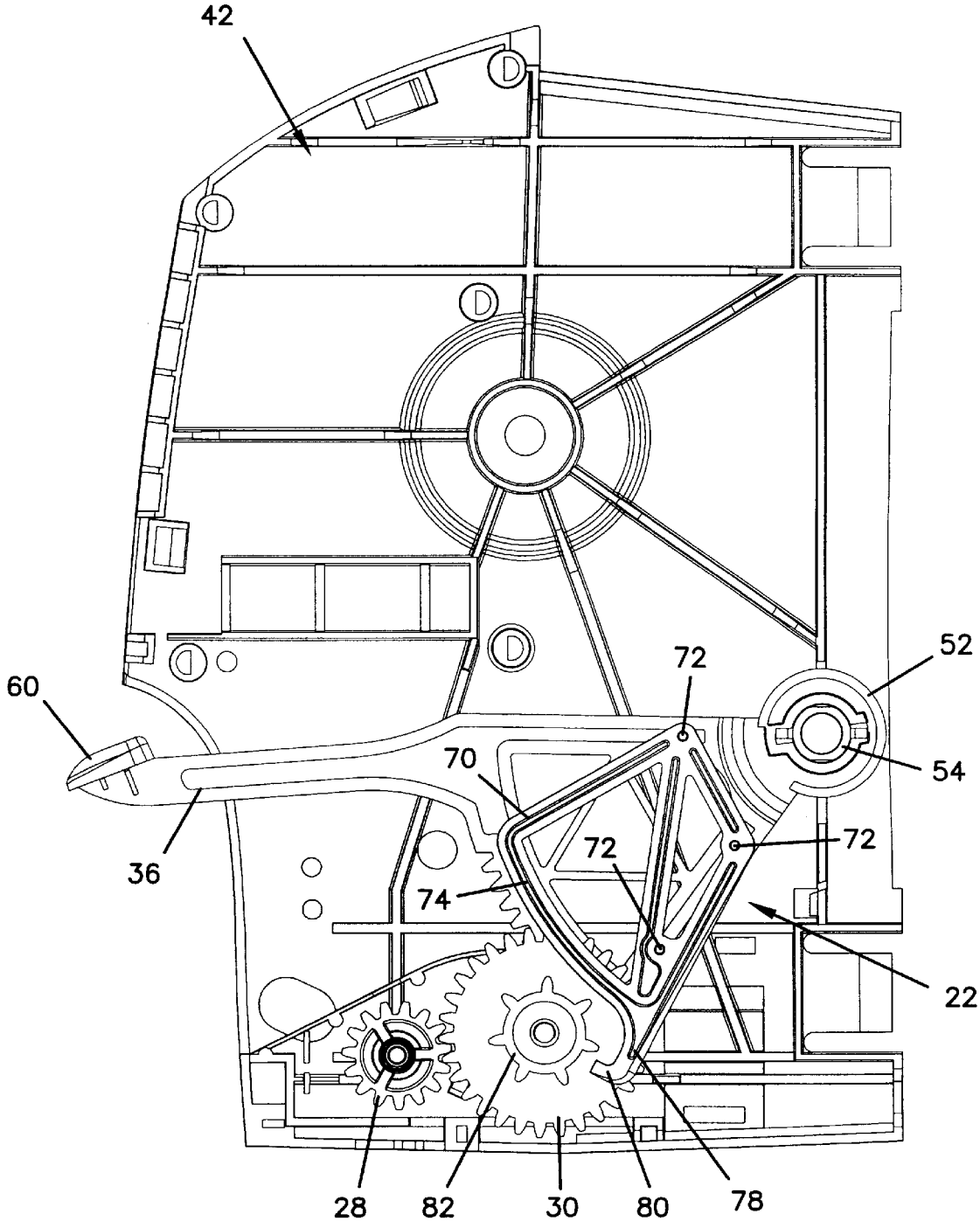
FIG. 5 is a view similar to FIG. 4, but showing the anti-free wheel mechanism disengaged just as the dispensing lever starts its downward stroke.

With reference to FIGS. 2A and 2B, as well as FIGS. 3–5, it is seen that a drive pinion 28 is driveably connected to the end of the drive roll 24 to cause rotation of the drive roll upon rotation of the drive pinion. The drive pinion 28 is driven by a dispensing gear 30 that, in turn, is driven by a drive gear 32. A pivotally mounted, arcuate gear segment 34 is engaged with the drive gear 32 to cause rotation thereof, and a dispensing lever 36 is connected to the gear segment 34 to cause actuation of the segment 34. The dispensing mechanism 20 is designed to dispense paper towel from the paper towel roll upon actuation of the dispensing lever 36, through the interaction of the gear segment 34, the drive gear 32, the dispensing gear 30, the drive pinion 28, and the drive and idler rolls 24, 26.

The anti-free wheel mechanism 22 is designed to interact with the dispensing mechanism 20 and prevent the gears thereof from being rotated via input from the drive pinion 28. In other words, the anti-free wheel mechanism 22 prevents paper towel from the web from being pulled out of the dispenser 10. In particular, the anti-free wheel mechanism 22 is designed to selectively engage with the dispensing gear 30 and thereby control the rotation thereof so that paper towel cannot be pulled from the dispenser 10.

Specific details of the dispensing and anti-free wheel mechanisms 20,22 are illustrated more completely in FIGS. 3–5. It is seen that the drive pinion 28 includes an integral stub shaft 38 projecting from one side thereof that is rotatably supported by the side housing portion 18. As best seen in FIG. 2B, the opposite side of the pinion 28 is drivingly engaged with the drive roll 24 via a drive member 40.

With continued reference to FIGS. 3–5, the drive member 40 freely extends through a hole (not shown) provided in an interior panel 42 that is disposed within the housing 12 and which cooperates with the side housing portion 18 to generally enclose the drive pinion 28, the dispensing gear 30, arcuate gear segment 34, dispensing lever 36, and the anti-free wheel mechanism 22 whereby these elements are separated from the interior space of the housing 12. Preferably, the side housing portion 18 and panel 42 are detachably connected together to permit access to the drive components, such as by providing a plurality of tabs that project from the interior surface of the side housing portion 18 that fit into corresponding posts 44 provided on the panel 42. It is to be realized that other forms of connection between the side housing portion 18 and the panel 42 could be provided as well.

The drive gear 32 and dispensing gear 30 arrangement is designed to enable the drive gear 32 and dispensing gear 30 to rotate together during a dispensing stroke of the dispensing lever 36, and to enable the drive gear 32 to rotate by itself while the dispensing gear 30 remains stationary during a return stroke of the dispensing lever 36, whereby only one way rotation of the dispensing gear 30 occurs.

More particularly, the side of the dispensing gear 30 that faces the drive gear 32 is formed with a central boss 46 that receives therein a conventional, uni-directional clutch bearing 47, best seen in FIG. 4. A shaft 48 is fixed to the drive gear 32 and extends through the clutch bearing 47, with a free end thereof projecting past the dispensing gear 30 and a fixed end thereof being fixed within a boss 49 that is integrally formed on the side of the drive gear 32 opposite the dispensing gear 30. The free end is rotatably received within a corresponding sleeve (not shown) provided on the side housing portion 18, while the boss 49 is rotatably supported within a sleeve (not shown) provided on the panel 42. Thus, the free end of the shaft 48 and the boss 49 combine to rotatably support the dispensing gear 30 and the drive gear 32 assembly.

The uni-directional clutch bearing 47 of the dispensing gear 30 is designed to support the shaft 48 such that rotation of the drive gear 32 in one direction causes a corresponding rotation of the dispensing gear 30 in the same direction (i.e. dispensing stroke), while the drive gear 32 rotates freely relative to the dispensing gear 30 when the drive gear 32 is rotated in the opposite direction (i.e. return stroke). The use of uni-directional clutch bearings, and their design, to allow such one-way rotation is known in the art, and the clutch bearing 47 is not further described herein.

The drive gear 32 is driven by the arcuate gear segment 34 that is engaged therewith. The gear segment 34 is formed by a body 50 having a pivot mount 52 at one end thereof that is disposed around a pivot stub shaft 54 mounted on the panel 42, whereby the gear segment 34 is pivotally mounted on the dispenser 10 for pivoting movements about the axis of the pivot stub shaft 54. The body 50 further includes an arcuate edge 56 that is provided with gear teeth 58 that mesh with the drive gear 32, whereby pivoting movements of the gear segment 34 result in rotation of the drive gear 32.

Projecting from the arcuate edge 56 of the gear segment 34 is the dispensing lever 36 which has an actuating end 60.

The lever 36 extends through a slot 62 formed in the front of the housing 12 so that the actuating end 60 thereof is accessible from outside the housing 12 to enable a user to actuate the dispensing mechanism 20. It is preferred that the gear segment 34 be biased in a clockwise direction (viewed from FIG. 4) whereby the dispensing lever 36 and actuation end 60 are biased to the upper end of the slot 62 as shown in FIGS. 1 and 3–4. Preferably, the gear segment 34 is biased by a coil spring disposed around the stub shaft 54, with the spring having one end engaged with the panel 42 and its other end engaged with the gear segment 34. However, other biasing mechanisms known in the art could be used as well.

As should be apparent from the description so far, and with reference to FIG. 4, when a user pulls/pushes down the actuation end 60 of the lever 36 (i.e. the dispensing stroke), the gear segment 34 is rotated in a counterclockwise direction about the axis of the shaft 54, thereby rotating the drive gear 32 in the clockwise direction about its axis. The clutch bearing 47 causes the dispensing gear 30 to be simultaneously rotated in the clockwise direction, which causes rotation of the pinion gear 28 in the counterclockwise direction. Since the pinion gear 28 is drivingly connected to the drive roll 24, the drive roll 24 is driven in a counterclockwise direction (when viewing FIG. 4) to dispense paper towel from the dispenser 10.

Once the dispensing lever 36 is released by the user, the gear segment 34 is biased back to its initial position, so that the dispensing lever 36 and actuation end 60 are returned to the top of the slot 62 (i.e. the return stroke). As the gear segment 34 returns to its initial position, the drive gear 32 is rotated thereby in the counterclockwise direction. However, the clutch bearing 47 prevents the rotation of the drive gear 32 from rotating the dispensing gear 30 during the return stroke, which prevents the drive roll 24 from being driven in a direction that would pull paper towel into the dispenser 10.

Normally, in the event that a person pulled on the end of the paper towel in an attempt to pull paper towel from the dispenser, the drive roll 24 would be rotated as a result of such action in its counterclockwise dispensing direction, resulting in the corresponding rotation of the drive pinion 28, dispensing gear 30, etc. However, the anti-free wheel mechanism 22 of the invention is designed to prevent the gears of the dispensing mechanism 20 from being rotated as a result of pulling paper towel from the dispenser 10, and thereby prevent paper towel from being pulled from the dispenser 10.

With reference to FIGS. 3–5, it is seen that the anti-free wheel mechanism 22 includes a frame 70 that is secured to the side of the gear segment body 50 such as by screws 72 or other suitable detachable connection whereby the frame 70 can be selectively connected to or removed from the body 50. The frame 70 includes an outer edge 74 that faces the outer edge 56 of the body 50, with the outer edge 74 extending generally the length of the gear teeth 58. As evident from FIG. 3, spacers 76 are provided between the body 50 and the frame 70 to form a space therebetween, and a portion of the dispensing gear 30 is rotatably disposed between the body 50 and the frame 70.

Extending from the outer edge 74 of the frame 70 is a latch 78 having a finger 80 on the end thereof. The latch 78 and finger 80 have a larger radius as measured from the shaft 54 than the gear teeth 58, for a reason to be discussed later.

Fixed to the side face of the dispensing gear 30 and rotatable therewith is a toothed wheel 82 having a series of circumferentially spaced teeth disposed on the outer surface thereof. The finger 80 on the latch 78 is designed to selectively engage with the toothed wheel 82 and thereby control the rotation of the toothed wheel 82, and thus control the rotation of the dispensing gear 30.

As shown in FIG. 4, when the dispensing lever 36 is at its first position at the top of the slot 62, the finger 80 is disposed between two teeth on the toothed wheel 82. Thus, clockwise rotation of the dispensing gear 30, which is necessary in order for a person to pull paper towel from the dispenser 10, is prevented, thereby preventing paper towel from being pulled from the dispenser. As a user pulls down on the dispensing lever 36 during a dispensing stroke of the lever 36, the finger 80 disengages from the toothed wheel 82, as shown in FIG. 5. Since the latch 78 and finger 80 have a larger radius that the gear teeth 58, the latch 78 moves faster than the toothed wheel 82, thus allowing the finger 80 and the wheel 82 to unlock. Continued downward movement of the lever 36 during the dispensing stroke causes a certain length of paper towel to be dispensed. Upon completion of the dispensing stroke, the lever 36 is released and biased back upward during its return stoke to the top of the slot 62, with the finger 80 re-engaging with the toothed wheel 82 to prevent further paper towel dispense until the lever 36 is again re-actuated downward.

The dispenser 10 and anti-free wheel mechanism 22 of the invention are thus simple in design and operation. Further, since the frame 70 is detachably connected to the body 50, the dispenser 10 can easily be used either with or without the anti-free wheel mechanism by simply removing the frame 70, thereby rendering the dispenser 10 more versatile.

Other variations are possible within the scope of the invention. For instance, the gear segment 34 could be missing a tooth at its intersection with the drive gear 32, thereby allowing the latch 78 to begin unlatching before the gearing starts to move. Further, the toothed wheel 82 need not have teeth. Instead, the wheel 82 could be simply a flat or round object and the latch 78 designed to engaged therewith. Numerous gear ratios for the gears 28, 30, 32, 58 could be used, in order to select a desired length of paper towel to be discharged for each actuation of the dispensing lever 36. In addition, the size of the wheel 82 can be decreased in size, which would allow the unlocking of the latch 78 to be smoother.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A towel dispenser, comprising:

a housing;

a dispensing mechanism associated with said housing for dispensing towel stored within said housing, said dispensing mechanism including a dispensing lever moveably supported by said housing whereby said lever is moveable from a first position to a second position and from said second position back to said first position, and a dispensing gear rotatably supported by said housing, said dispensing gear in driving engagement with said dispensing lever and rotatable thereby in a first direction; and a latch fixed to said dispensing lever and moveable therewith when said dispensing lever moves between said first and second positions, said latch engaged with said dispensing gear to prevent rotation thereof in said first direction whenever said dispensing lever is at said first position.

2. The towel dispenser according to claim 1, wherein said dispensing lever is pivotally supported by said housing for pivoting movement between said first and second positions.

3. The towel dispenser according to claim 1, wherein said latch is detachably connected to said dispensing lever.

4. The towel dispenser according to claim 1, further including a wheel fixed to said dispensing gear, and said latch is engageable with said wheel.

5. The towel dispenser according to claim 4, wherein said wheel includes a plurality of circumferentially spaced teeth thereon, and said latch includes a finger that is disposed between a pair of said teeth when said dispensing lever is at said first position.

6. The towel dispenser according to claim 1, wherein said dispensing mechanism further includes a drive gear in driving engagement with said dispensing gear for rotating said dispensing gear in said first direction only, and an arcuate gear segment pivotally supported within said housing and in driving engagement with said drive gear, and said dispensing lever is connected to said arcuate gear segment.

7. The towel dispenser according to claim 6, wherein said dispensing mechanism further includes a drive pinion engaged with said dispensing gear, and a drive roll in driving engagement with said drive pinion.

8. The towel dispenser according to claim 6, wherein said arcuate gear segment includes an arcuate edge having gear teeth disposed thereon, and said latch has a radius measured from a pivot axis of said arcuate gear segment that is greater than a radius of said gear teeth.

9. The towel dispenser according to claim 6, further including a frame connected to said arcuate gear segment, said latch is connected to said frame and said frame is spaced from said arcuate gear segment to define a gap therebetween.

10. The towel dispenser according to claim 9, wherein said dispensing gear is at least partially disposed in said gap between said frame and said arcuate gear segment.

* * * * *